US009469422B2

(12) United States Patent
Lasnier et al.

(10) Patent No.: US 9,469,422 B2
(45) Date of Patent: Oct. 18, 2016

(54) UNIT COMPRISING A REFILLABLE BOTTLE AND A SOURCE OF PRODUCT

(71) Applicant: ALBEA LE TREPORT, Le Treport (FR)

(72) Inventors: Jacky Lasnier, Sainte Marquerite sur Duclair (FR); Jean-Luc Octau, Intraville (FR); Emmanuel Mauduit, Abbeville (FR)

(73) Assignee: ALBEA LE TREPORT, Le Treport (FR)

( * ) Notice: Subject to any disclaimer, the term of this patent is extended or adjusted under 35 U.S.C. 154(b) by 0 days.

(21) Appl. No.: 14/247,647

(22) Filed: Apr. 8, 2014

(65) Prior Publication Data

US 2014/0305543 A1 Oct. 16, 2014

(30) Foreign Application Priority Data

Apr. 16, 2013 (FR) ..... 13 53445

(51) Int. Cl.
*B65B 3/10* (2006.01)
*B05B 11/00* (2006.01)

(52) U.S. Cl.
CPC ..... *B65B 3/10* (2013.01); *B05B 11/0056* (2013.01); *B05B 11/3043* (2013.01); *B05B 11/3047* (2013.01); *B05B 11/3049* (2013.01); *B05B 11/3001* (2013.01)

(58) Field of Classification Search
CPC ..... A45D 34/00; B65B 1/04
USPC ..... 141/2, 6, 22, 23, 113, 156, 157, 321, 141/330, 349; 222/212
See application file for complete search history.

(56) References Cited

U.S. PATENT DOCUMENTS 1,914,791 A * 6/1933 Schmitt et al. ..... 222/209
3,142,319 A * 7/1964 Russo et al. ..... 141/113
3,181,737 A * 5/1965 Chaucer ..... 222/136
3,270,525 A * 9/1966 Sellers ..... 63/1.15

(Continued)

FOREIGN PATENT DOCUMENTS

EP 126718 A2 * 11/1984 ..... A61J 1/00
EP 1579924 A1 9/2005

(Continued)

OTHER PUBLICATIONS

French Application 1353445, Search Report, dated Nov. 6, 2013.

*Primary Examiner* — Mark A Laurenzi
*Assistant Examiner* — Andrew Schmid
(74) *Attorney, Agent, or Firm* — Banner & Witcoff, Ltd.

(57) ABSTRACT

The invention relates to a unit comprising a refillable bottle for dispensing a fluid product and a source (15) of product intended for the filling of said refillable bottle, said source comprising a reservoir (18) provided with a device for dispensing, said refillable bottle comprising a reservoir (2) and a device (10) for dispensing, said refillable bottle provided with a valve (14) for filling the reservoir (2), with the opening of the source (15) provided with a socket (23) for the reversible connection of the device for dispensing by putting into sealed communication the means for supplying said device with the source reservoir (18), said socket being arranged, after disconnection of the device for dispensing, to allow for the connection of the refillable bottle by actuating the opening of the valve (14) in order to put into sealed communication the reservoirs (2, 18) for the purposes of filling.

17 Claims, 4 Drawing Sheets

(56) References Cited

U.S. PATENT DOCUMENTS

| | | | | |
|---|---|---|---|---|
| 4,458,830 | A * | 7/1984 | Werding | 222/131 |
| 5,190,190 | A * | 3/1993 | Fudalla | 222/105 |
| 5,292,033 | A * | 3/1994 | Gueret | 222/95 |
| 5,306,125 | A * | 4/1994 | Weag | 417/472 |
| 5,333,761 | A * | 8/1994 | Davis et al. | 222/212 |
| 5,462,099 | A * | 10/1995 | Demarest et al. | 141/3 |
| 5,524,680 | A * | 6/1996 | de Laforcade | 141/18 |
| 5,623,974 | A * | 4/1997 | Losenno et al. | 141/20 |
| 5,871,126 | A * | 2/1999 | Bennett et al. | 222/207 |
| 6,062,437 | A * | 5/2000 | Mascitelli | 222/212 |
| 6,435,231 | B1 * | 8/2002 | Cooper et al. | 141/346 |
| 6,607,012 | B2 * | 8/2003 | Yquel | 141/20 |
| 6,997,219 | B2 * | 2/2006 | Py et al. | 141/314 |
| 7,665,635 | B2 * | 2/2010 | Ramet et al. | 222/321.7 |
| 8,079,388 | B2 * | 12/2011 | Turgeman | 141/113 |
| 8,596,501 | B2 * | 12/2013 | Hagleitner | 222/207 |
| 8,695,896 | B2 * | 4/2014 | Tu | 239/333 |
| 8,739,839 | B2 * | 6/2014 | Muller | 141/18 |
| 2005/0016622 | A1 * | 1/2005 | Risch et al. | 141/113 |
| 2005/0211731 | A1 * | 9/2005 | Ramet | 222/321.9 |
| 2007/0175924 | A1 * | 8/2007 | Lompech et al. | 222/321.1 |
| 2008/0067196 | A1 * | 3/2008 | Octau | 222/321.7 |
| 2008/0164344 | A1 * | 7/2008 | Lompech et al. | 239/333 |
| 2008/0251541 | A1 * | 10/2008 | Cornet et al. | 222/209 |
| 2009/0194191 | A1 * | 8/2009 | Turgeman | 141/18 |
| 2010/0032451 | A1 * | 2/2010 | Neuhaus et al. | 222/207 |
| 2010/0310426 | A1 * | 12/2010 | Campbell et al. | 422/100 |
| 2011/0061764 | A1 * | 3/2011 | Springer | 141/1 |
| 2011/0297275 | A1 * | 12/2011 | Farrar et al. | 141/113 |
| 2011/0309110 | A1 * | 12/2011 | Dumont et al. | 222/321.7 |
| 2012/0090730 | A1 * | 4/2012 | Dumont et al. | 141/2 |
| 2012/0103926 | A1 * | 5/2012 | Ibsies | 215/228 |
| 2012/0205401 | A1 | 8/2012 | Litten et al. | |
| 2012/0255647 | A1 * | 10/2012 | Dumont et al. | 141/311 R |
| 2012/0312842 | A1 * | 12/2012 | Dumont et al. | 222/321.9 |
| 2012/0312843 | A1 * | 12/2012 | Dumont et al. | 222/321.9 |
| 2013/0008981 | A1 * | 1/2013 | Bloc et al. | 239/480 |
| 2013/0269830 | A1 * | 10/2013 | Farrar et al. | 141/27 |
| 2014/0060695 | A1 * | 3/2014 | Dumont et al. | 141/18 |
| 2014/0069551 | A1 * | 3/2014 | Lasnier et al. | 141/18 |
| 2014/0086770 | A1 * | 3/2014 | Octau et al. | 417/437 |
| 2014/0102584 | A1 * | 4/2014 | Lasnier et al. | 141/18 |
| 2014/0102585 | A1 * | 4/2014 | Lasnier et al. | 141/18 |
| 2014/0137983 | A1 * | 5/2014 | Tu | 141/113 |
| 2014/0305543 | A1 * | 10/2014 | Lasnier et al. | 141/18 |

FOREIGN PATENT DOCUMENTS

| | | | | |
|---|---|---|---|---|
| FR | 2630712 | A1 * | 11/1989 | B65D 47/28 |
| FR | 2802447 | A1 * | 6/2001 | B05B 11/02 |
| FR | 2942208 | A1 | 8/2010 | |
| GB | 2483087 | A | 2/2012 | |
| WO | WO 9726997 | A1 * | 7/1997 | B05B 11/00 |
| WO | 2013014626 | A2 | 1/2013 | |

* cited by examiner

UNIT COMPRISING A REFILLABLE BOTTLE AND A SOURCE OF PRODUCT

CROSS REFERENCE TO RELATED APPLICATIONS

This application claims the benefit of French Patent Application No. FR-13 53445 filed Apr. 16, 2013, which is hereby incorporated herein by reference in its entirety.

The invention relates to a unit comprising a refillable bottle for dispensing a fluid product and a source of product intended for the filling of said bottle.

In particular, the refillable bottle allows for the dispensing of a liquid product, for example of a cosmetic care, make-up or perfuming product, or a pharmaceutical product.

The refillable bottle comprises a reservoir for conditioning the product as well as a device for dispensing the conditioned product which is mounted in a sealed manner on said reservoir. In particular, the device for dispensing can include a manually-actuated pump which is supplied with conditioned product, said pump being arranged to dispense the product under pressure, for example in the form of an aerosol. Alternatively, the device for dispensing can include means for applying the product, for example in the form of a ball.

In an example of application, the refillable bottles according to the invention allow for the dispensing of product samples, in particular for a volume of conditioned product in the reservoir which is between 1 and 10 ml. In particular, the samples dispensed as such can allow a customer to test the product, with the bottles then being qualified as tester bottles of samples. Alternatively, the bottles can be referred to as "in bag" in that they make it possible to easily transport a reduced volume of product, as opposed to bottles with a higher capacity which are in general heavy and bulky as they are plush.

In these applications, for example for reasons of logistics, practicality or environmental for recycling, it may be desirable to be able to refill the reservoir with product using a source of said product. In effect, it is rather impractical for a user to carry out the filling of the reservoir using a small funnel and not very ecological to discard an empty bottle in order to replace it with a full one forming a refill.

Fillable bottles are already offered for sale, wherein the reservoir is provided with a filling valve of said reservoir that is arranged to allow for the putting into communication of a source of product with said reservoir for the purposes of filling it. In particular, the valve comprises a passage of communication between the source and the reservoir, said passage being provided with a valve which is mobile in relation to said passage between a closed sealed position and an open position of said passage.

In order to carry out the filling, prior art proposes to use a source bottle comprising a dispensing pump, with the valve being displaced by means of an ejector of said pump. In particular, the sealed pressing of the ejector on the valve allows for the reversible opening of said valve as well as the actuating of the pump in order to inject source product in the reservoir through the valve.

However, this embodiment requires removing beforehand the push-button provided on the ejector of the pump of the source bottle and actuating several times said ejector in order to inject a sufficient volume of product, which is difficult and rather non-intuitive for the user. Furthermore, putting the push-button back incorrectly on the ejector after filling is potentially detrimental to the proper later operation of the source bottle for the dispensing of the product that it contains. In addition, putting it back in position inevitably causes an actuating of the pump, therefore the undesired dispensing of at least one dose of product.

Moreover, this embodiment poses sealing problems during the filling, in particular due to the difficulty in correctly positioning the ejector as a sealed pressing on the valve by exerting a force that is sufficient to jointly cause the opening of the valve and the actuating of the pump, and this all the more so that the pump must be actuated several times in order to inject a sufficient volume of product.

The invention aims to perfect prior art by proposing in particular a unit allowing for the filling of a bottle on a source of product with a particularly easy and intuitive gesture, while still improving the seal of the filling.

To this effect, the invention proposes a unit comprising a refillable bottle for dispensing a fluid product and a source of product intended for the filling of said refillable bottle, said source comprising a reservoir for conditioning said product which is provided with an opening wherein a device for dispensing the conditioned product is mounted, said refillable bottle comprising a reservoir intended for the conditioning of said product and a device for dispensing said conditioned product which is mounted in a sealed manner on said reservoir, said refillable bottle being provided with a filling valve of the reservoir which is arranged to allow for the putting into communication of the source of product with the reservoir for the purposes of filling it, with the opening of the source being provided with a socket for reversibly connecting the device for dispensing by putting into sealed communication means for supplying said device with the source reservoir, said socket being arranged to, after the disconnection of the device for dispensing, allow for the connection of the refillable bottle by actuating the opening of the valve in order to put into sealed communication the reservoirs for the purposes of filling them.

Other objectives and advantages of the invention shall appear in the following description, made in reference to the annexed figures, wherein.

Figure 1:
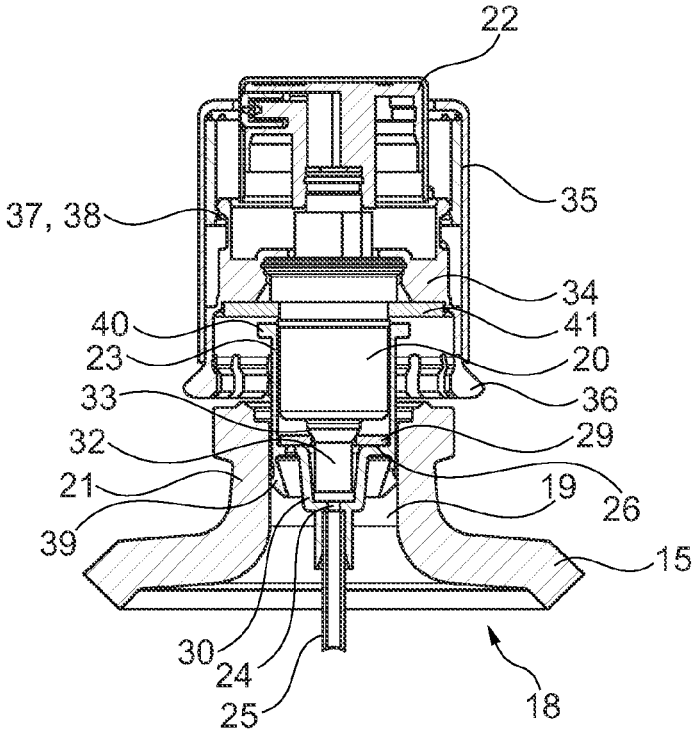
FIG. 1 is a partial view as a partial longitudinal cross-section of a source of product of a unit according to an embodiment of the invention, wherein the device for dispensing is shown during the first connection onto said source.

In the description, the terms of positioning in space are taken in reference to the straight position of the source and of the refillable bottle such as shown in the figures.

With regards to the figures, a unit is described hereinbelow comprising a refillable bottle intended to contain a fluid product for the purposes of dispensing it. In particular examples, the product can be liquid, in particular a cosmetic care, make-up or perfuming product, or a pharmaceutical product.

The refillable bottle comprises a body 1 wherein a reservoir 2 for conditioning the product is formed. According to a particular application, the reservoir 2 can have a capacity between 1 and 10 ml in such a way as to allow for the dispensing of product samples.

According to an embodiment, the body 1 is rigid, in particular by having a rigidity that is sufficient for the volume of the reservoir 2 to remain substantially constant, even if the internal pressure varies. The body 1 can be of a single piece, for example made via injection blow moulding or extrusion blow moulding, or of several parts that are injected then assembled, for example by ultrasonic welding, or by laser, or by rotating friction, made of rigid plastic material, of metal, for example of aluminium, or of glass.

In the embodiment shown, the body 1 has a tubular base 3 which extends between a bottom 4 and an upper opening 5, the reservoir 2 being formed inside said base. Advantageously, the tubular base 3 can be covered with a finishing aimed at perfecting the aesthetics of the refillable bottle.

The body 1 comprises a cover 6 having a lower annular skirt 7 which is arranged in the upper opening 5 by being associated to it in a sealed manner, for example by welding, in particular by rotating friction. The cover 6 also has an upper neck 8 wherein is formed an opening 9 for access inside the refillable reservoir 2.

The refillable bottle comprises a device 10 for dispensing conditioned product which is mounted in a sealed manner on the reservoir 2. In the embodiment shown, the device for dispensing comprises a pump 10 that is fixed in the opening 9 of the neck 8 by allowing for the supply of said pump with conditioned product. In particular, the pump 10 is actuated manually by means of a push-button 11, said pump being supplied with product by the intermediary of a plunger tube 12 that is arranged in the reservoir 2.

However, the invention is not limited to one mode of dispensing the product. In particular, other types of means of sampling the product in the reservoir 2 can be considered. The device 10 for dispensing can also include means for applying the product, for example in the form of a ball.

The push-button 11 comprises a dispensing orifice 13 and an upper zone that allows the user to exert a press of the finger on it in order to displace the ejector of the pump 10 over its course of supply of said orifice with product under pressure. In the embodiment shown, the push-button 11 is provided with a spraying nozzle which is arranged to radially dispense an aerosol of the product through the dispensing orifice 13. However, in particular for a nasal tip for spraying, the push-button 11 can allow for an axial dispensing of the product. Alternatively, the product can be dispensed in the form of a knob or a slick.

The bottle is provided with a filling valve 14 of the reservoir 2 that is arranged in order to allow for the putting into communication of a source 15 of product with said reservoir for the purposes of filling it. In relation with the figures, the valve 14 comprises a passage 16 for communication with the refillable reservoir 2, said passage being provided with a valve 17 for the opening/closing of said passage. In particular, the passage 16 is formed in the bottom 4 of the body 1 in such a way as to in particular fill the reservoir 2 by said bottom, which corresponds to an intuitive gesture.

The unit also comprises the source 15 of product which is intended for the filling of the refillable bottle, said source comprising a reservoir 18 for the conditioning of said product which is provided with an opening 19 wherein a device 20 for dispensing of the conditioned product is mounted.

In the embodiment shown, the source 15 of product is in the form of a bottle of which the reservoir 18 is surmounted with a neck 21 wherein a dispensing pump 20 is mounted in order to be supplied with conditioned product. As such, in addition to its filling function, by manual actuating of the push-button 22 of the pump 20, the source 15 can be used as a bottle for dispensing the product contained in the source reservoir 18, in particular in the form of an aerosol, a knob or a slick of product.

The opening 19 of the source 15 is provided with a socket 23 that is mounted in the neck 21, said socket being arranged in order to allow for the reversible connection of the device 20 for dispensing by putting into sealed communication the means for supplying said device with the source reservoir 18. Furthermore, the socket 23 is arranged, after disconnection of the device 20 for dispensing, to allow for the connection of the refillable bottle by actuating the opening of the valve 14 in order to put into sealed communication the reservoirs 2, 18 for the purposes of filling.

As such, via a simple gesture of connecting/disconnecting the device 20 for dispensing—respectively of the refillable bottle—the dispensing of the product contained in the source reservoir 18 is carried out without risk of deterioration of said device for dispensing—respectively the filling of the refillable reservoir 2 by guaranteeing a satisfactory seal during the transfer of the product from the source reservoir 18 to the refillable reservoir 2.

In particular, the refillable reservoir 2 can have a vacuum that is arranged to, via the connection of the refillable bottle, induce the filling of said reservoir via suction of the conditioned product in the source reservoir 18. To do this, a refillable bottle can be provided of which the device 10 for dispensing operates without the return of air in the reservoir 2 as compensation for the volume of product dispensed. In particular, the pump 10 can be devoid of a vent hole or include a vent hole which is closed off or arranged in such a way as to not provide its function of a return of air.

In the embodiment shown, the socket 23 for connecting has an orifice 24 for communicating that exits in the source reservoir 18, said orifice being provided with a plunger tube 25 that extends inside the source reservoir 18. In particular, the pump 20 of the source bottle can then be devoid of a plunger tube, which greatly facilitates its removal in order to be able to connector the refillable bottle.

The orifice 24 for communicating is surmounted by a seat 26 whereon the means for supplying the device 20 for dispensing—respectively the filling valve 14—are intended to come as a sealed press during the connection of said device for dispensing—respectively of the refillable bottle. As such, par simple axial pressing of the device 20 for dispensing—respectively of the bottle for dispensing—on the seat 26, the means for supplying —respectively the valve 14—are placed into communication with the source reservoir 18.

In order to facilitate the connection, the socket 23 has an upper housing 27 wherein the means for supplying—respectively the filling valve 14—are intended to be received in a reversible manner during the connection of the device 20 for dispensing—respectively of the refillable bottle. In particular, the housing 27 provides an axial guidance of the device 20 for dispensing and of the refillable bottle during their respective sliding, as such facilitating their proper positioning on the seat 26 in order to render reliable the seal of the connection via axial pressing.

In order to improve this guidance, the housing 27 is provided with an orifice 28 for equalising the pressure between said housing and the source reservoir 18. As such, it is possible to benefit from a housing 27 having an inside dimension which is similar to the outside dimension whereon the filling bottle and the device 20 for dispensing are guided, and this without risking a piston effect in said housing during the connection/disconnection.

Advantageously, the seat 26 is provided with a seal 29 whereon the sealed pressing is carried out, said seal having an annular geometry wherein exits the communication orifice 24, said geometry having lower and upper surfaces that are flat in order to favour the axial seal by pressing.

In the embodiment shown, the socket 23 for connecting has a bucket 30 that extends between the seat 26 and the orifice 24 for communicating, said bucket being connected to the peripheral wall of the socket 23 by the intermediary of a seating 31 whereon said seat is formed, the orifice 28 for equalising the pressure also being formed through said seating. In particular, the bucket 30 and the seat 26 delimit at the bottom the housing 27 of the socket 23, as such preventing, when said housing is empty between two connections, substantially all access to the source reservoir 18 by the intermediary of the opening 19.

The device 20 for dispensing comprises a lower tip 32 which is provided with a supply duct, said tip is intended, during the connection of said device, to be arranged in the bucket 30 by having a peripheral seal in said seat. In particular, the tip 32 has an upper seating 33 which is diverging and tapered in order to forced in the seal so as to make the conferred seal reliable by radial tightening.

In relation with FIG. 1, the socket 23 is mounted in the neck 21 during the first connection of the pump 20 during its fastening onto the source bottle. To do this, the pump 20 is mounted in the housing 27 in an intermediate axial position wherein the seating 33 is positioned on the seal 29, with the pump 20/socket 23 unit being introduced by axial sliding in the opening 19 of the neck 21.

Figure 2:
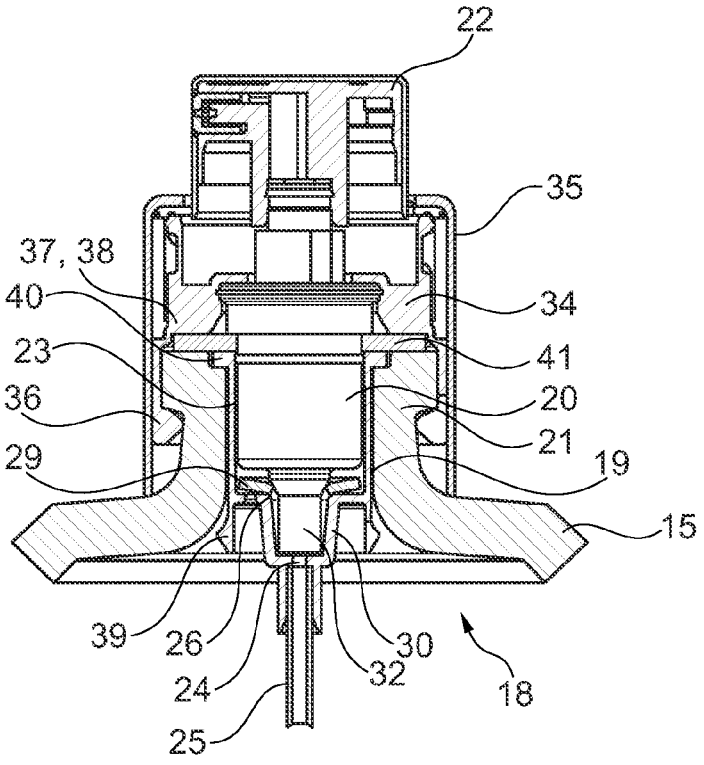
FIG. 2 is a view similar to that in FIG. 1, wherein the device for dispensing is shown connected onto the source, with FIG. 2*a* being an enlarged view of a portion of FIG. 2.
Figure 2A:
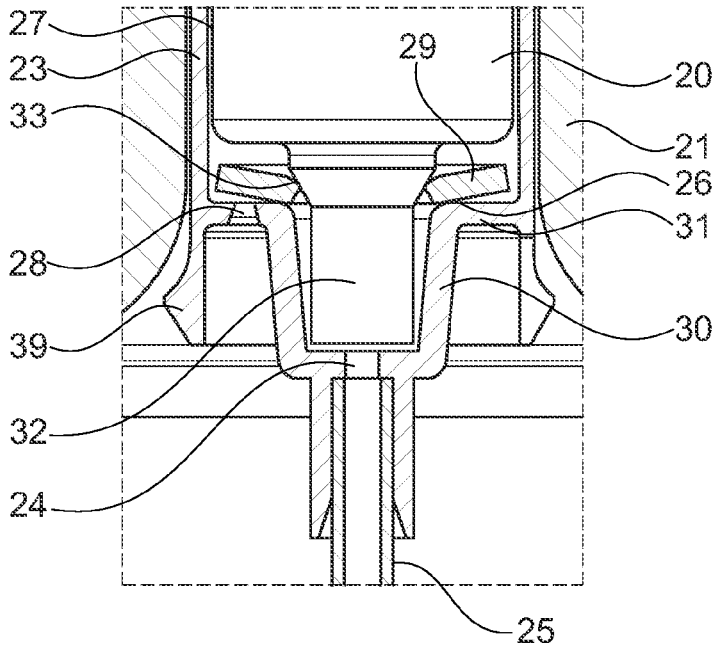

Then, the device 20 for dispensing is connected in the socket 23 by reversible fastening on the neck 21 (FIG. 2). To do this, the device 20 for dispensing comprises a sleeve 34 provided with means of fastening around the neck 21 and a hoop 35 mounted around said sleeve by the intermediary of a device for reversible displacement between a high position wherein the means for fastening are free in such a way as to allow for the positioning of said sleeve around said neck and a low position wherein said means for fastening are forced on said neck in order to provide for the sealed fastening of said sleeve on said neck.

The embodiment shown is similar to that described in document FR-2 948 64 wherein in particular: the means of fastening include claws 36 which can be folded back under the neck 21 by sliding of the hoop 35 and the device for displacement is actuated by rotation relative of the hoop 35 in relation to sleeve 34 by providing that said sleeve have sliders 37 wherein protrusions 38 of the hoop 35 are engaged in order to transform the movement of rotation into relative translation. In another embodiment, the fastening of the pump 20 can be carried out by a sleeve to be screwed on the threaded neck of the source.

Advantageously, the fastening of the pump 20 onto the neck 21 induces an axial displacement of said pump in the housing 27, said displacement being arranged in order to ensure a sealed pressing between the seating 33 and the seal 29. In particular, the socket 23 for connecting is provided with retaining means that cooperate geometrically with the neck 21, said means being arranged to retain the socket 23 during the disconnection and/or the connection of the device 20 for dispensing—respectively the filling of the filling valve 14.

The means for retaining allow in particular the mounting of the socket 23 in the neck 21 by sliding downwards but, once said socket is mounted, limit the possibilities of extraction—respectively of penetrating—of the socket 23 in the neck 21. In the embodiment shown, the socket 23 for connecting comprises retractable lugs 39 which are engaged under the neck 21 and an upper flange 40 that is arranged on the locking ring of said neck. As such, the flange 40 provides the axial abutting of the socket 23 in the neck 21 in order to guarantee the course of sealed pressing during the connection, with the lugs 39 retaining said socket in the neck 21 during the disconnection.

According to an embodiment, the socket 23 is mounted floating in the neck 21 over an axial course that is delimited by the flange 40 and the lugs 39. In particular, the peripheral wall of the socket 23 wherein the housing 27 is formed has an outside dimension that is slightly less than the inside dimension of the neck 21, said wall being surmounted by the flange 40 and the lugs 39 extending under said wall by surrounding the bucket 30.

The device 20 for dispensing can include a sealed seating that comes to press on the socket 23 for connecting and/or on the neck 21 when said device is fastened onto said neck, in particular in order to seal the interface between the peripheral wall of said socket and said neck. In the embodiment shown, the sleeve 34 is provided with a seal 41 which is arranged axially pressing on the flange 40 and on the locking ring of the neck 21 in order to provide for the seal of the fastening of the pump 20 onto said neck.

Figure 4:
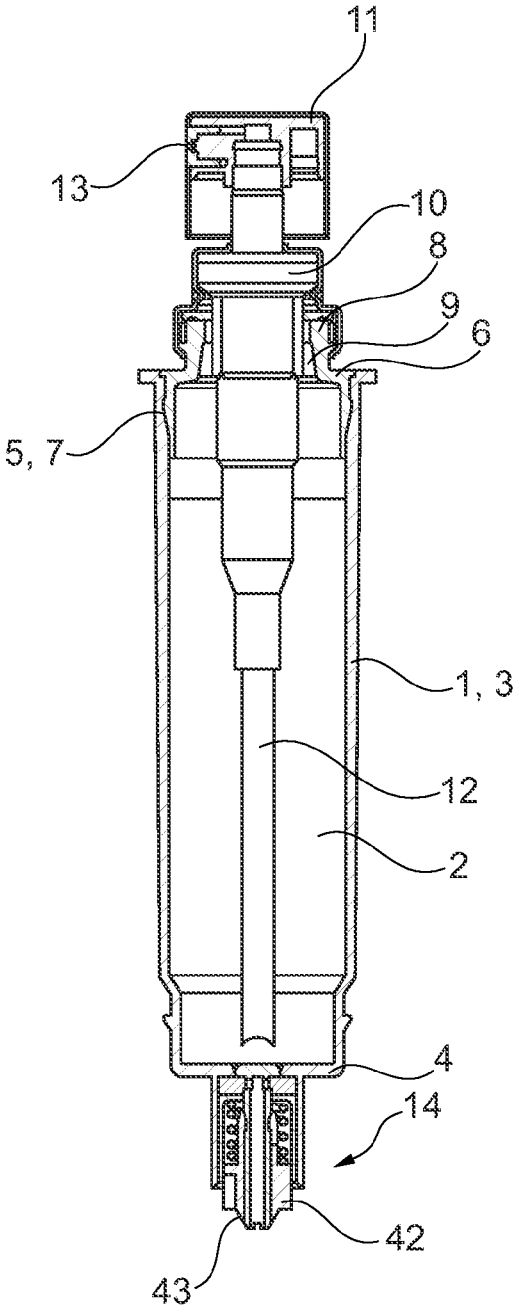
FIG. 4 is a partial view as a partial longitudinal cross-section of a refillable bottle of a unit according to an embodiment of the invention, with FIG. 4*a* being an enlarged view of a portion of FIG. 4.
Figure 5:
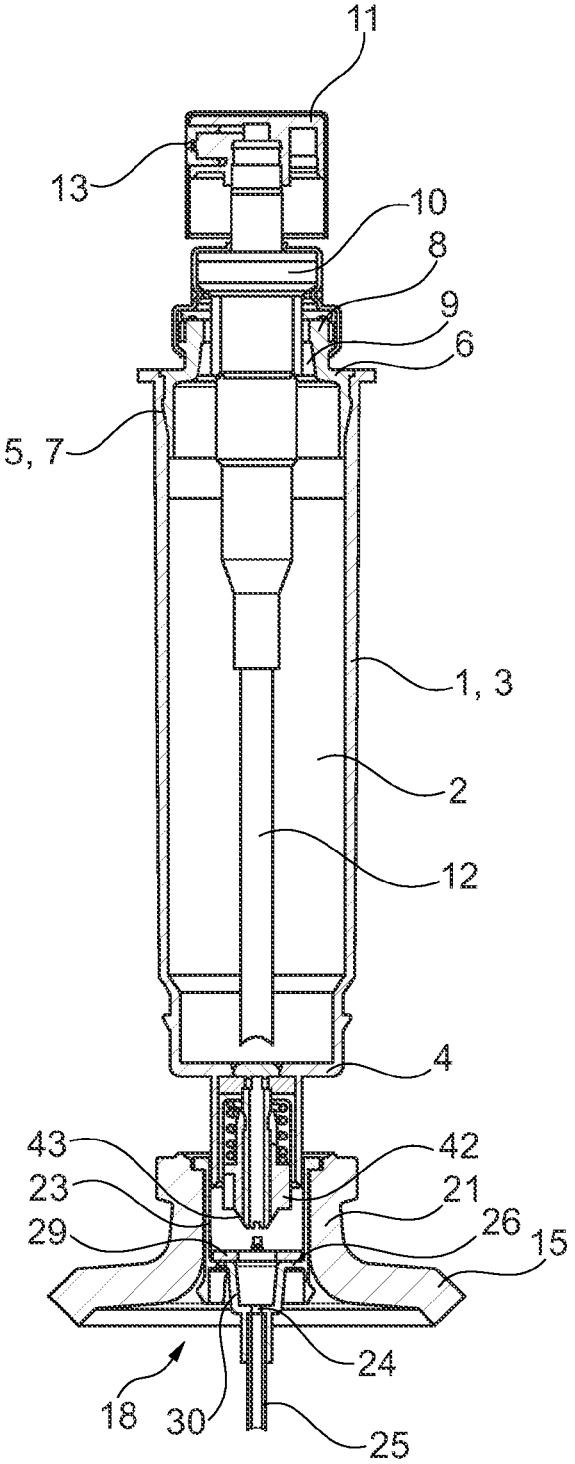
FIG. 5 is a partial view as a partial longitudinal cross-section of the bottle of FIG. 4 during connection on the source of FIG. 1.
Figure 6:
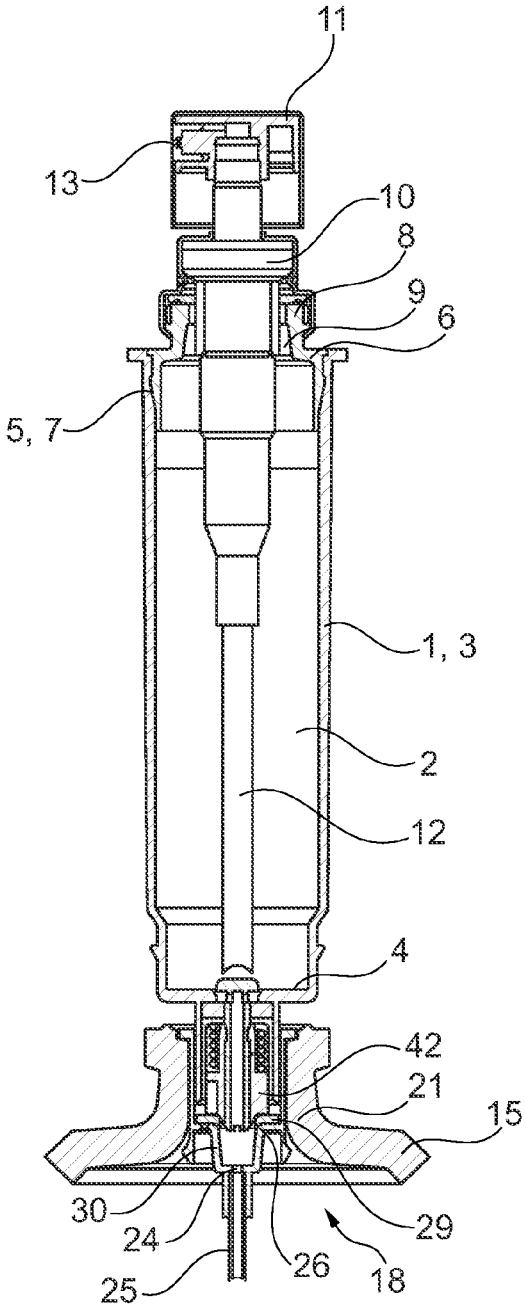
FIG. 6 is a view similar to that in FIG. 5 wherein the refillable bottle is connected to the source, with FIG. 6*a* being an enlarged view of a portion of FIG. 6.
Figure 4A:
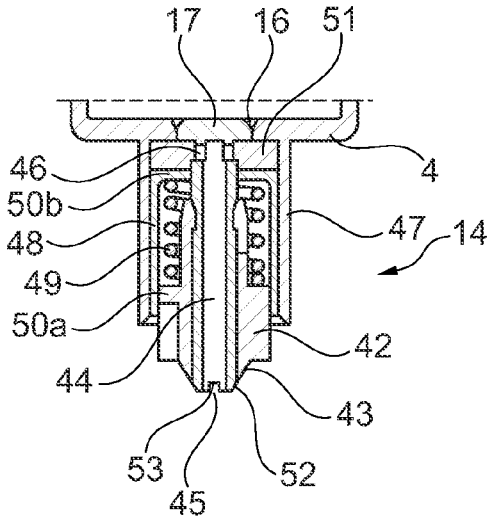
Figure 6A:
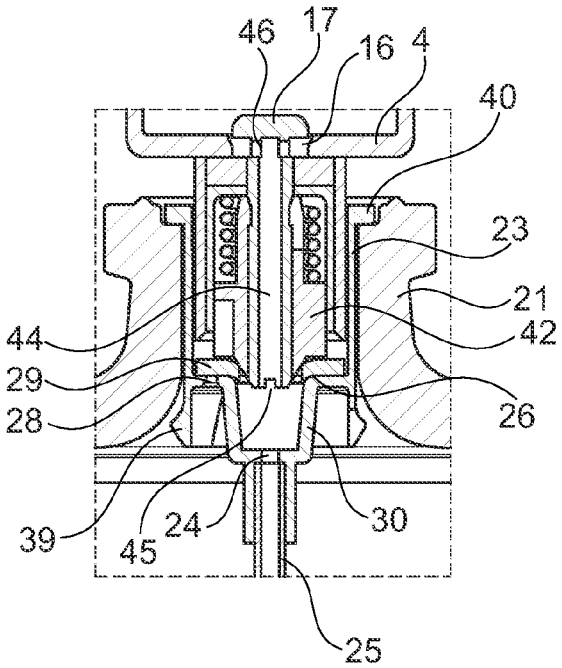

In relation with FIGS. 4 to 6, the filling valve 14 comprises a rod 42 for the reversible opening of the communication through said valve, said rod able to be actuated by the sealed pressing of a seating 43 of said rod on the seat 26 during the connection of the refillable bottle.

The rod 42 is provided with an internal channel 44 that extends between an upstream orifice 45 intended to be in sealed communication with the source reservoir 18 during the connection of the refillable bottle and a downstream orifice 46, said rod able to be actuated between a stable closed position of the downstream orifice 46 and a forced position of putting into communication of said downstream orifice with the source reservoir 18.

In the embodiment shown, the passage 16 of the refillable reservoir 2 exits inside a cage 47 formed under the bottom 4 of said reservoir, with the rod 42 being mounted in forced axial translation inside a ring 48 which is fixed in a sealed manner in said cage. In particular, a compression spring 49 is arranged between two radial shoulders 50*a*, 50*b* respectively of the rod 42 and of the ring 48, a seal 51 being arranged around the passage 26 between the bottom 4 and the shoulder 50*b* of the ring 48.

The rod 42 has the valve 17 for the sealed closing of the communication between the passage 16 and the downstream orifice 46 when said rod is in stable position. In the embodiment shown, the valve 17 is formed on the upper end of the rod 42 which is mounted in the passage 16, with downstream orifices 46 being formed under said valve in order to be arranged in the passage 16 when the rod 42 is raised axially in the forced position of putting into communication.

Advantageously, the upstream orifice 45 is separated from the seating for pressing 43 by a portion 52 of rod that is provided with a vent structure 53, said structure being located so that the seating 43 can be in sealed communication with the source reservoir 18 during the connection of the refillable bottle by pressing and in order to prevent the putting into sealed communication of the upstream orifice 45 with the source reservoir 18 by pressing on said portion. As such, the possibility of refilling the bottle is limited on a source 15 of which the seat 26 is suited to confer the sealed pressing only on the seating 43 provided for this effect on the rod 42.

In particular, the refilling of the bottle on the ejector of the pump of a source bottle can be prohibited by providing that the upstream orifice 45 exit axially under a lower portion 52 of the rod 42, said portion having at least one lateral opening of a vent 53 which is located to keep open the internal channel 44 in the event of a sealed axial pressing around said upstream orifice.

In relation with the figures, the rod 42 has a lower seating 43 which is diverging and tapered in order to confer a sealed pressing inside the seal 29, with the upstream orifice 45 being surrounded by at least one lateral opening of a vent 53 which exits in the internal channel 44 and under said tapered seating. As such, only the axial course of penetrating of the seating 43 into the seal 29 in order to confer the sealed radial tightening makes it possible to arrange the openings 53 in sealed communication with the source reservoir 18 in order to induce the refilling. Otherwise, the internal channel 44 is in communication with the air by the intermediary of the openings 53, prohibiting any refilling, in particular through suction.

Figure 3:
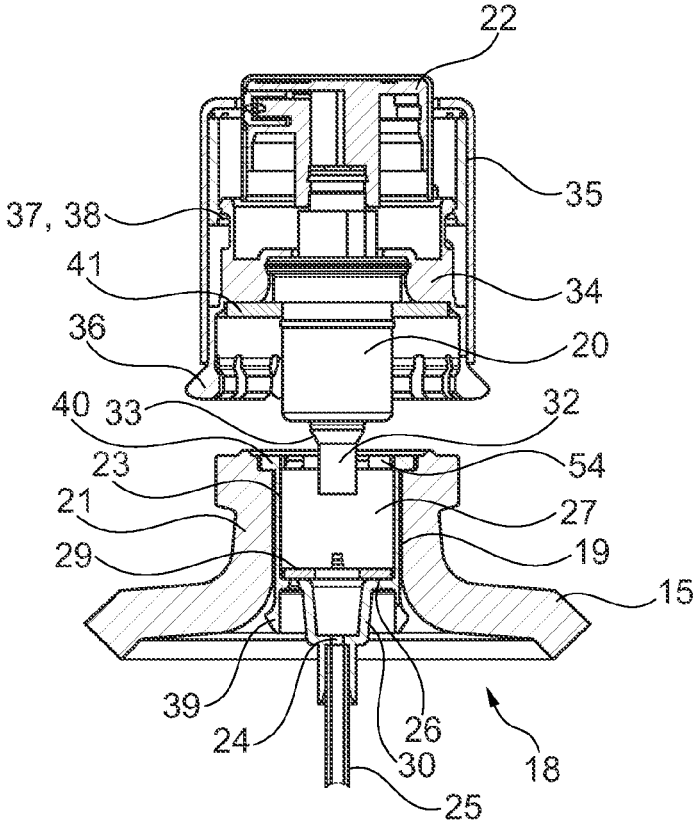
FIG. 3 is a view similar to that in FIG. 1, wherein the device for dispensing is shown during the removal after it is disconnected.

Moreover, the socket 23 can have a vent structure 54 that prohibits the seal of any device whatsoever aiming to withdraw the product from the source 15, other than the device 20 arranged to be connected in said socket. In relation with FIG. 3, the vent structure 54 has at least one passage formed in the flange in order to prevent the sealed mounting of a device inside said flange.

The invention claimed is:

1. Unit comprising a refillable bottle for dispensing a fluid product and a source of product intended for the filling of said refillable bottle, said source comprising a reservoir for conditioning said product which is provided with an opening wherein a device for dispensing the conditioned product is mounted, said refillable bottle comprising a reservoir intended for the conditioning of said product and a device for dispensing said conditioned product which is mounted in a sealed manner on said reservoir, said refillable bottle being provided with a filling valve of the reservoir which is arranged in order to allow for the putting into communication of the source of product with the reservoir for the purposes of filling it, said unit being characterised in that the opening of the source is provided with a socket for reversibly connecting the device for dispensing by putting into sealed communication means for supplying said device with the source reservoir, said socket being arranged to allow for the connection of the refillable bottle by actuating the opening of the valve in order to put into sealed communication the reservoirs for the purposes of filling while the device for dispensing is not connected to the source.

2. Unit according to claim 1, characterised in that the socket for reversibly connecting has an orifice for communicating that exits in the source reservoir, said orifice being provided with a seat whereon the means for supplying the device for dispensing respectively the filling valve are intended to come as a sealed pressing during the connection of said device for dispensing respectively of the refillable bottle.

3. Unit according to claim 2, characterised in that the seat is provided with a seal whereon the sealed pressing is carried out.

4. Unit according to claim 2, characterised in that the socket for connecting has a housing wherein the means for supplying respectively the filling valve are intended to be received in a reversible manner during the connection of the device for dispensing respectively of the refillable bottle.

5. Unit according to claim 2, characterised in that the orifice for communicating is provided with a plunger tube that extends inside the source reservoir.

6. Unit according to claim 2, characterised in that the socket for connecting has a bucket which extends the seat and the orifice for communicating, said bucket being connected to a peripheral wall of the socket by the intermediary of a seating whereon the seat is formed, with the means for supplying the device for dispensing comprising a tip which, during the connection of said device, is intended to be arranged in the bucket by having a peripheral seal in said seat.

7. Unit according to claim 2, characterised in that the filling valve comprises a rod for the reversible opening of the communication through said valve, said rod able to be actuated par a sealed pressing of a seating of said rod on the seat during the connection of the refillable bottle.

8. Unit according to claim 7, characterised in that the rod is provided with an internal channel that extends between an upstream orifice intended to be in sealed communication with the source reservoir during the connection of the refillable bottle and a downstream orifice, said rod able to be actuated between a stable position of closing of the downstream orifice and a forced position of putting into communication of said downstream orifice with the source reservoir.

9. Unit according to claim 8, characterised in that the source reservoir has a passage, with the rod having a valve for the sealed closing of the communication between said passage and the downstream orifice when said rod is in stable position.

10. Unit according to claim 8, characterised in that the upstream orifice is separated from the seating by a portion of the rod which is provided with a vent structure, said structure being located so that the sealing can be in sealed communication with the source reservoir during the connection of the refillable bottle by pressing and in order to prevent the putting into sealed communication of the upstream orifice with the source reservoir by pressing on the portion.

11. Unit according to claim 10, characterised in that the upstream orifice axially exits under a lower portion of the rod, said portion having at least one lateral vent opening which is located to keep open the internal channel in the event of a sealed axial pressing around said upstream orifice.

12. Unit according to claim 1, characterised in that the source has a neck wherein the socket for reversibly connecting is mounted.

13. Unit according to claim 12, characterised in that the socket for connecting is provided with means for retaining that cooperate geometrically with the neck, said means being arranged in order to retain the socket during the disconnecting and/or the connecting of the device for dispensing respectively of the filling valve.

14. Unit according to claim 12, characterised in that the device for dispensing is connected in the socket via reversible fastening onto the neck.

15. Unit according to claim 14, characterised in that the device for dispensing comprises a sleeve provided with means for fastening around the neck and a hoop mounted around said sleeve by the intermediary of a device for the reversible displacement between a high position wherein the means for fastening are free in such a way as to allow for the positioning of said sleeve around said neck and a low position wherein said means for fastening are forced onto said neck in order to provide for the sealed fastening of said sleeve onto said neck.

16. Unit according to claim 1, characterised in that the refillable reservoir has a vacuum that is arranged to, via connection of the refillable bottle, induce the filling of said reservoir by suction of the conditioned product in the source reservoir.

17. Unit according to claim 16, characterised in that the device for dispensing the refillable bottle operates without the return of air in said reservoir as compensation for the volume of product dispensed.

* * * * *